US006902442B2

(12) United States Patent
Huang et al.

(10) Patent No.: US 6,902,442 B2
(45) Date of Patent: Jun. 7, 2005

(54) ELECTRICAL CONNECTOR

(75) Inventors: Wei Huang, Kunsan (CN); Renzhi Li, Tu-Chen (TW); Lin Zhong, Kunsan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/912,962

(22) Filed: Aug. 6, 2004

(65) Prior Publication Data

US 2005/0032438 A1 Feb. 10, 2005

(30) Foreign Application Priority Data

Aug. 6, 2003 (TW) ..... 92214292 U

(51) Int. Cl.[7] ..... H01R 13/405
(52) U.S. Cl. ..... 439/736; 439/722; 29/883
(58) Field of Search ..... 439/736, 722, 439/74, 65; 29/883

(56) References Cited

U.S. PATENT DOCUMENTS

| | | | | | |
|---|---|---|---|---|---|
| 5,641,290 | A | * | 6/1997 | Yagi | 439/74 |
| 5,772,474 | A | * | 6/1998 | Yagi et al. | 439/736 |
| 5,779,505 | A | * | 7/1998 | Yagi et al. | 439/736 |
| 5,931,689 | A | * | 8/1999 | Patel | 439/346 |
| 6,010,370 | A | * | 1/2000 | Aihara et al. | 439/736 |
| 6,155,886 | A | | 12/2000 | Koseki et al. | |

* cited by examiner

*Primary Examiner*—Tho D. Ta
(74) *Attorney, Agent, or Firm*—Wei Te Chung

(57) ABSTRACT

An electrical connector (1) includes an elongate insulative housing (10) and a number of contacts (2). The insulative housing has two side walls (12) and a slot (14) between the side walls. Each side wall defines an elongate cavity (11) and a number openings (15). The contacts are received in inner surfaces (141) of the side walls. The openings extend inwardly from outer surfaces of the side walls to the contacts.

4 Claims, 5 Drawing Sheets

ELECTRICAL CONNECTOR

BACKGROUND OF THE INVENTION

1. Field of the Invention

The present invention relates to an electrical connector, and more particularly to an electrical connector having a plurality of terminals securely retained therein.

2. Description of the Related Art

Electrical connectors are used in a variety of applications. One type of connector is commonly known as a board-to-board connector for interconnecting two circuit boards. A board-to-board connector typically includes interengageable male and female connectors. The female connector typically comprises a slot for connecting with a central mating portion of the male connector. A plurality of terminals is arranged with in the slot with a longitudinal spacing therebetween known as the "pitch".

To promote miniaturization, compact connectors are desirable. The pitch of the terminals is reduced from 0.635 to 0.5 mm and the housing is increasingly thin. A conventional method for forming an electrical connector is to assemble a plurality of terminals in a molded housing. A problem with such a method is that the terminals tend to deform and deflect due to an excessive assembly force during the assembly process. Accordingly, an insert molding method is employed to make small pitch connectors. U.S. Pat. No. 6,155,886 discloses such a board-to-board connector comprising an insulative housing having a pair of side walls each defining a plurality of exposed openings in a top surface thereof, and a plurality of terminals insert molded in the insulative housing. During molding process of the insulative housing, the terminals each can keep a correct position via a protrusion portion of an upper mold. The protrusion of the upper mold needs to extend into the openings of the top surfaces of the side walls, so the flows of molding materials will be obstructed thereby resulting in that an upper portion of the insulative housing will be deformed.

Hence, an improved electrical connector is required to overcome the disadvantages of the prior art.

SUMMARY OF THE INVENTION

A major object of the present invention is to provide an insert-molded electrical connector having terminals exhibiting a better coplanarity to the housing.

In order to achieve the object set forth, an electrical connector comprises insulative housing and a plurality of contacts. The insulative housing has two side walls and a slot between the sidewalls. Each side wall defines an elongate cavity and a plurality of openings. The contacts are received in inner surfaces of the side wall. The openings extend inwardly from outer surfaces of the side walls to the contacts.

Other objects, advantages and novel features of the invention will become more apparent from the following detailed description when taken in conjunction with the accompanying drawings.

DETAILED DESCRIPTION OF THE INVENTION

Figure 1:
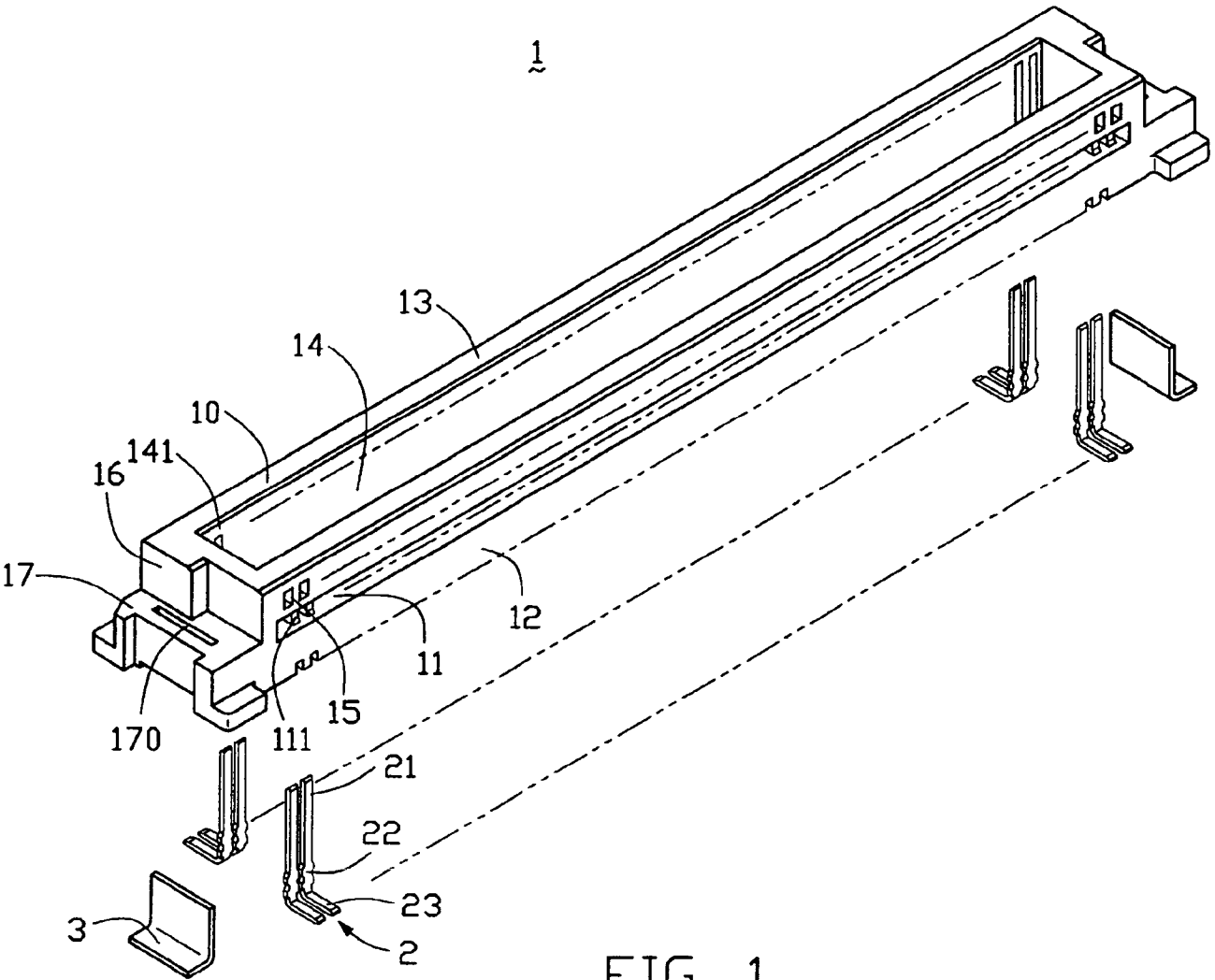
FIG. 1 is an exploded, perspective view of an electrical connector in accordance with the present invention.
Figure 2:
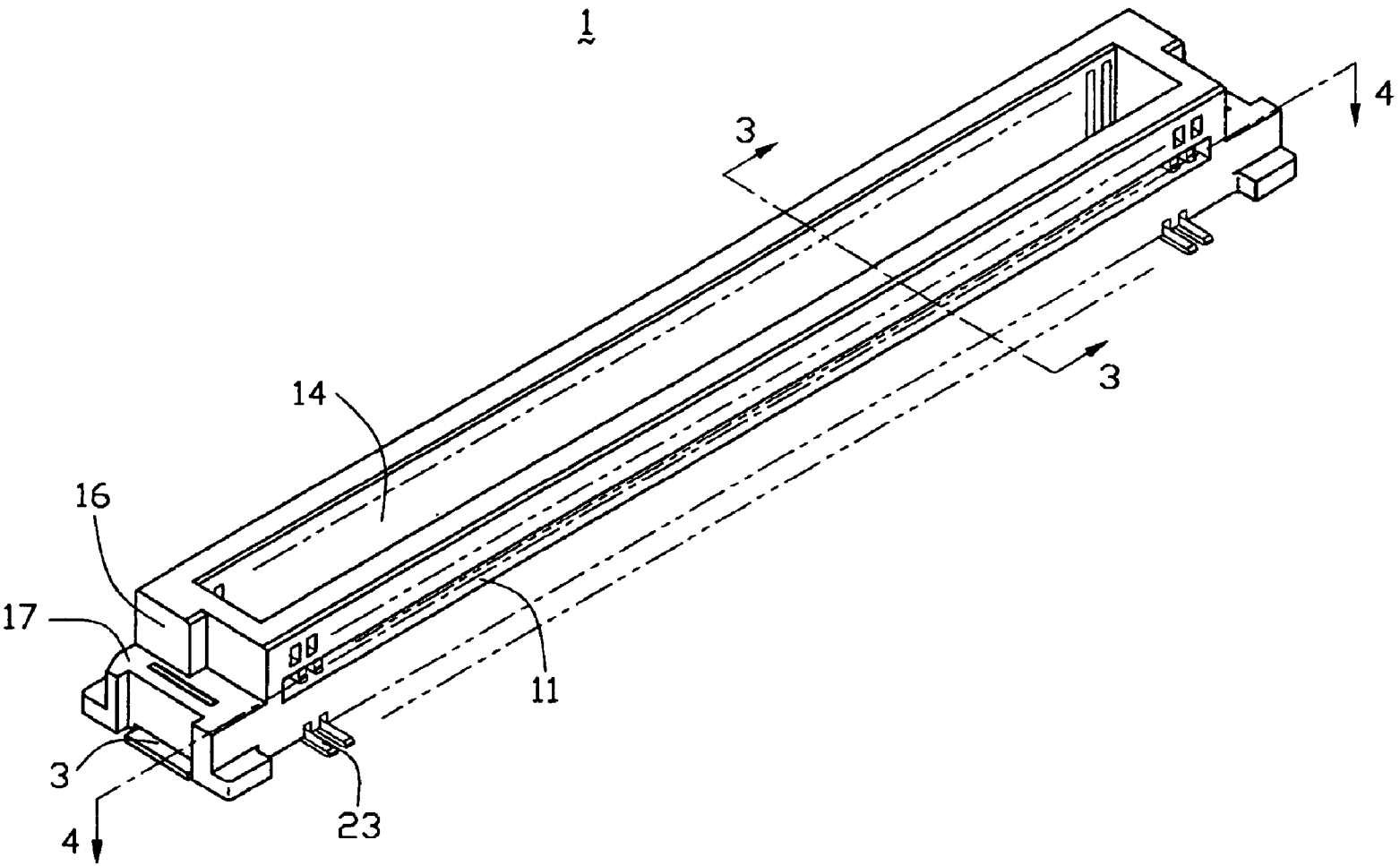
FIG. 2 is an assembled, perspective view of the electrical connector of FIG. 1.

Referring to FIGS. 1 and 2, an electrical connector 1 comprises an insulative housing 10, a plurality of contacts 2, a pair of soldering pads 3.

Figure 3:
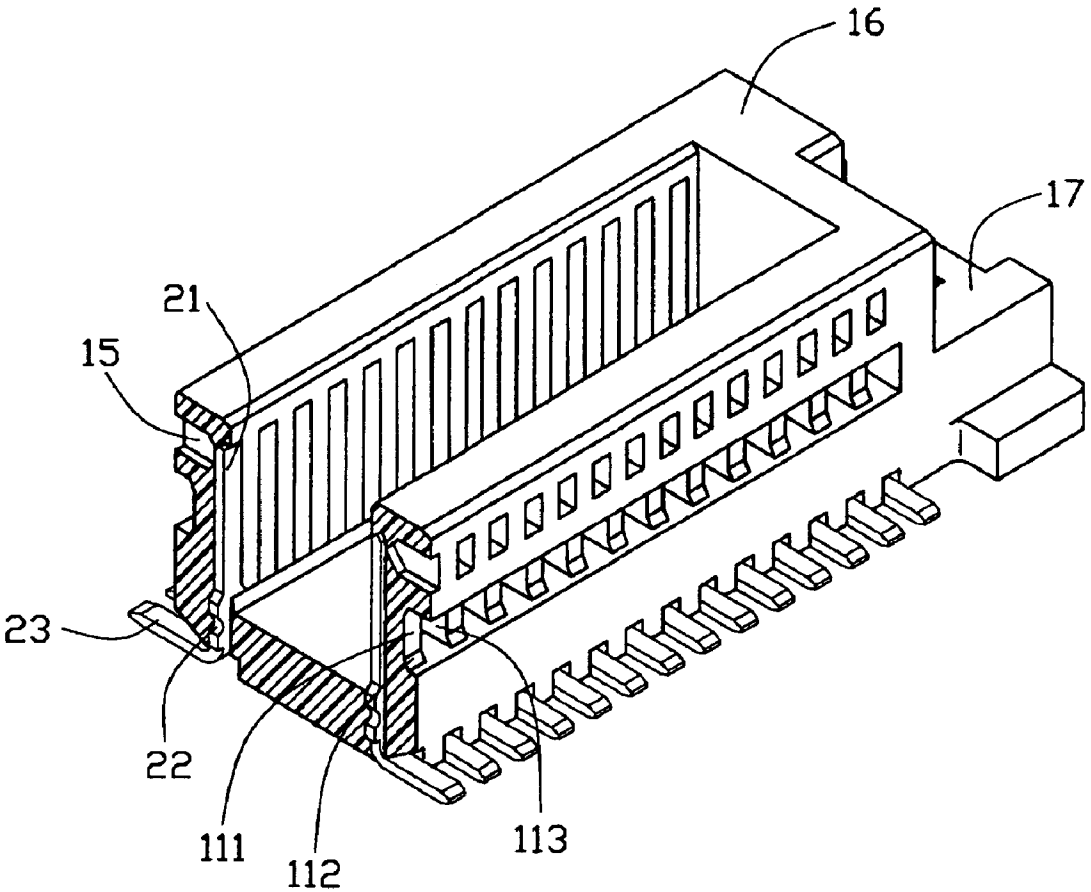
FIG. 3 is a cross-sectional view taken along line 3—3 of FIG. 2.
Figure 4:
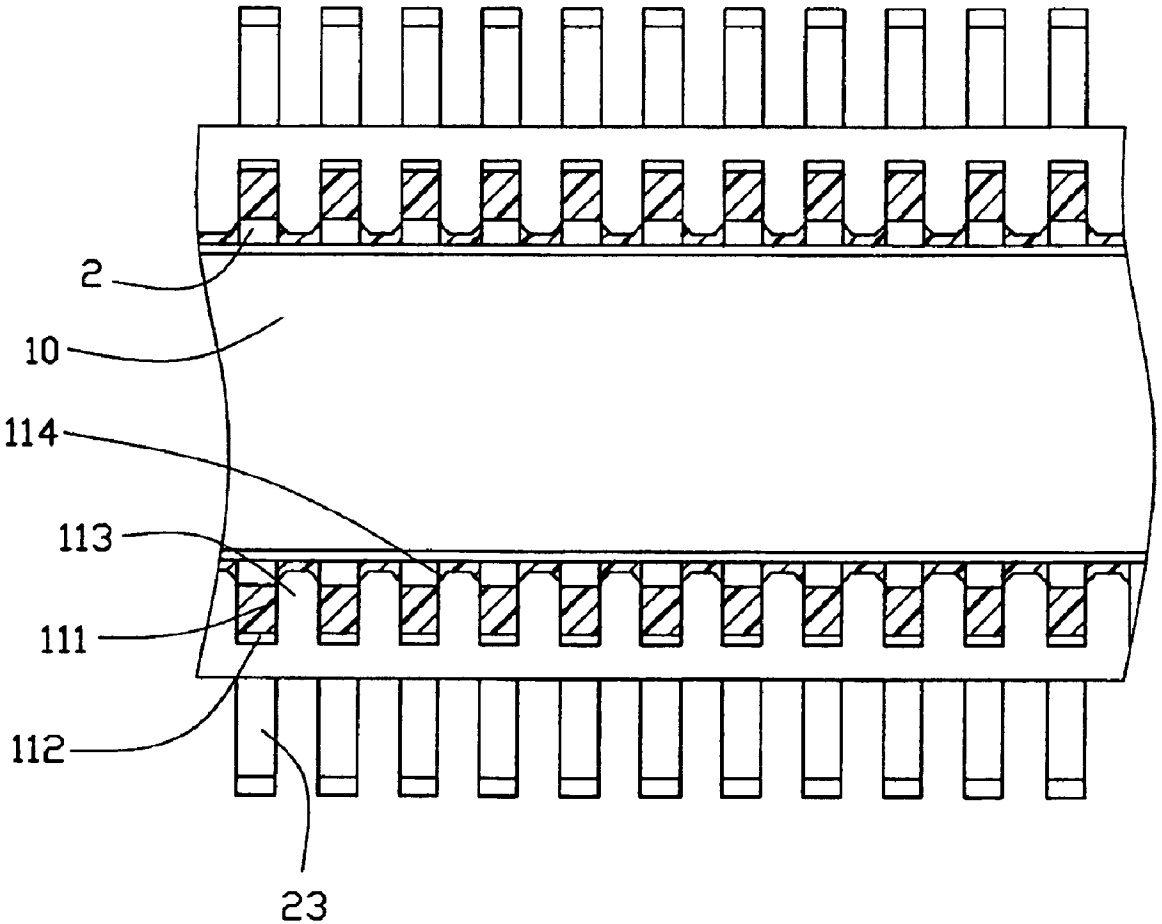
FIG. 4 is a cross-sectional view taken along line 4—4 of FIG. 2.

The insulative housing 10 is elongate and comprises a mating face 13 and opposite side walls 12 extending downwardly from the mating face. The mating face 13 defines a slot 14 at a middle portion thereof. Referring to FIGS. 3–4, each side wall 12 defines an elongate cavity 11 at an outer surface. A plurality of ribs 111 corresponding to the contact 2 is arranged in the cavity 111. An upper and a lower ends of the rib 111 respectively form a ramp 112. A hole 113 is defined between two ribs 111 and includes a cone portion 114 at a rear end thereof for reinforcing the securing strength of contacts 2. The side wall 12 defines a plurality of V-shaped openings 15 corresponding the contacts 2. The insulative housing 10 forms a pair of projections 16 at two ends thereof for guiding a complementary connector (not shown) mating with the connector 1. A pair of retention stations 17 is positioned at bottom ends of the projections 16 and each form a slit 170 for mating with the soldering pad 3.

Each contact 2 comprises an engaging portion 21 received in an inner surface 141 of the slot 14 of the insulative housing 10, a retention portion 22 secured in a bottom portion of the insulative housing 10, and a soldering portion 23 soldered to a printed circuit board (PCB).

Figure 5:
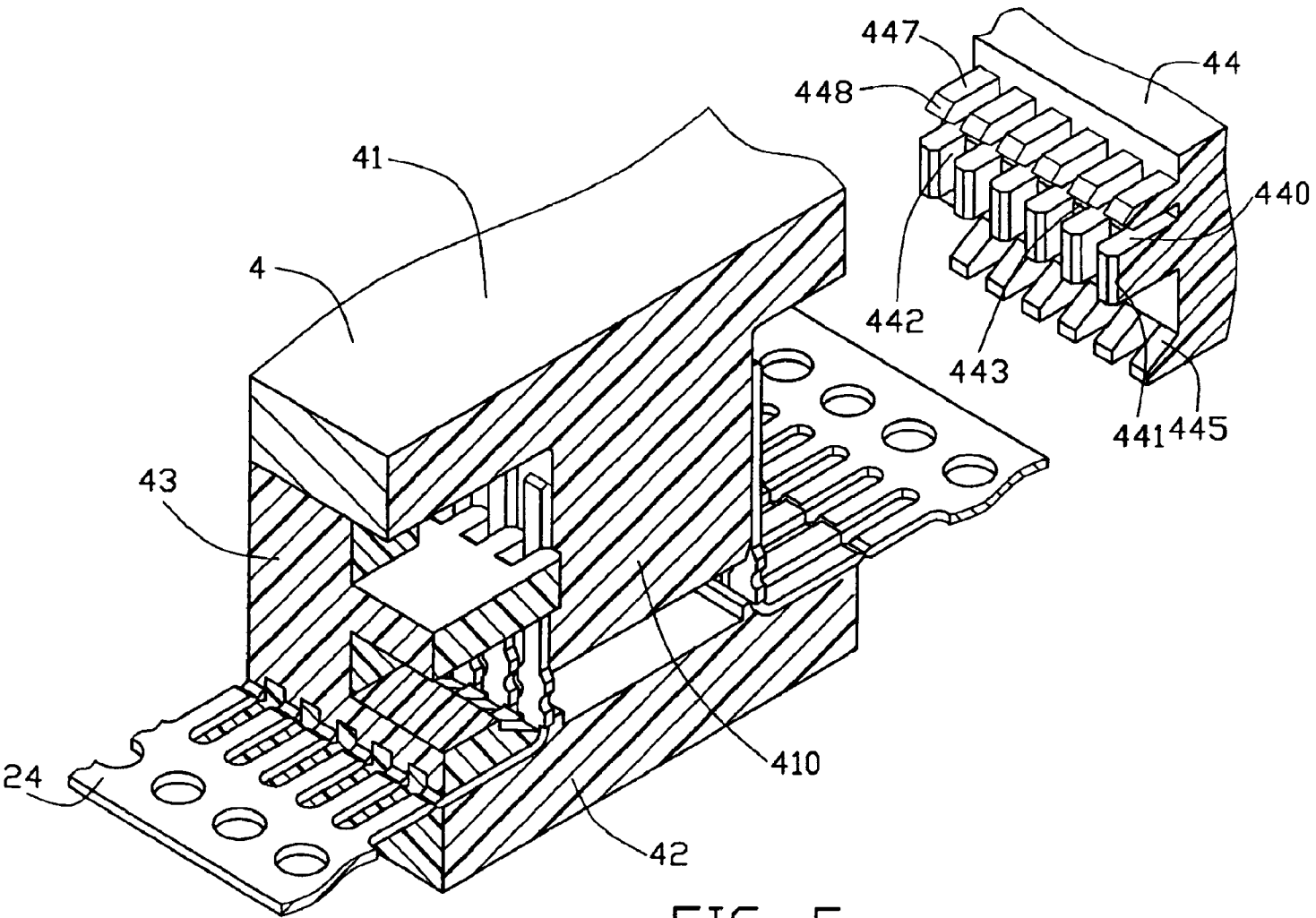
FIG. 5 is a partially assembled view of a number of contacts and a molding device.

Referring to FIGS. 4–5, in forming processes, two rows of the contacts 2 having carriers 24 are first assembled into a molding device 4 and the molding device 4 is utilized to form the connector 1. The molding device 4 comprises an upper, a lower, a left, and a right molding portions 41, 42, 43, 44. The left and the right molding portion 43, 44 are symmetrical. Thus, the right and the left molding portions 44, 43 have the same structures. A molding actor 410 extends downwardly from a lower end of the upper molding portion 41. A plurality of securing fingers 447 is formed at an upper end of the right molding portion 44 and utilized to secure the contacts 2 between the securing fingers 447 and the molding actor 10. Each securing finger 447 forms a guiding angle 448 at a rear end thereof. The V-shaped openings 15 are made via the securing fingers 447 and the guiding angles 448 are jet-molded. A plurality of protrusions 440 adjacent to the engaging portions 21 of the contacts 2 is formed at a middle portion of the right molding portion 44 thereof. A recess 442 is formed between the two protrusions 442 for forming the ribs 111 of the insulative housing 10 by jet-molding. The protrusions 440 fix the engaging portions 21 of the contacts 2 for preventing the engaging portions 21 slanting along an extending direction of the insulative housing 10.

Each protrusion 440 forms a guiding angle 441 at a rear end thereof for forming the cone portion 114 of the hole 113. The recesses each 442 also form a pair of slating portions 443 at an upper and a lower end thereof for corresponding to and molding the ramps 112 of the ribs 111. A low end of the right molding portion 44 forms a pressing portion 445 pressing the soldering portions 23 of the contacts 2 for securing the soldering portions 23 on the PCB. The carriers 24 are cut from the soldering portions of the contacts 2.

Finally, the soldering pads 3 are installed in the slits 170 of the retention stations 17, assemblies of the connector 1 are completed.

The openings 15 of the side walls 12 of the present invention can provide a function of fixing position to the contacts 2. At the same time, the openings 15 also can apply flows of molding materials smooth on an upper end of the inner surface 141 of the slot 14. So, planarity of a bottom end of the insulative housing 10 can be improved.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

an insulative housing having two side walls and a central slot between the side walls along a longitudinal direction thereof, each side wall defining an elongate cavity and a plurality of openings; said central slot communicating with an exterior through a mating face of the housing;

two rows of contacts insert molded within internal faces of said two side walls of the housing and located by two sides of the central slot, respectively, each of said contacts defining a vertical mating portion located on the corresponding internal face;

wherein a plurality of ribs is arranged in the cavity, and a hole is defined between every two ribs and includes a cone portion at a rear end thereof;

wherein each rib has a pair of ramps at an upper and a lower ends thereof;

said holes extending inwardly from an exterior face of each of said side walls and located between two mating portions of every adjacent two contacts, respectively, each of said holes directly facing the mating portions of the two contacts by two sides thereof in the longitudinal direction; and said openings extending inwardly from the exterior face of each of said side walls and respectively located in alignment with the mating portion of the corresponding contact in a lateral direction perpendicular to said longitudinal directions;

wherein said openings are located adjacent to the mating face;

wherein rear portions of the openings adjacent to the contacts are V-shaped;

wherein said holes and said openings are arranged at different levels in a vertical direction perpendicular to both said longitudinal direction and said lateral direction.

2. The electrical connector as claimed in claim 1, further comprising a pair of soldering pads each received in the slit of the retention station.

3. The electrical connector as claimed in claim 1, wherein the insulative housing forms a pair of projections at two ends thereof for guiding a complementary connector to mate with the connector.

4. The electrical connector as claimed in claim 3, wherein a pair of retention stations is positioned at bottom ends of the projections and each defines a slit.

* * * * *